United States Patent [19]

Nakamura et al.

[11] Patent Number: 5,064,301

[45] Date of Patent: Nov. 12, 1991

[54] THERMAL PRINTER

[75] Inventors: Tadashi Nakamura, Morioka; Toshiyuki Yamamoto, Takizawa, both of Japan

[73] Assignee: Alps Electric Co., Ltd., Tokyo, Japan

[21] Appl. No.: 504,160

[22] Filed: Apr. 3, 1990

[30] Foreign Application Priority Data

Apr. 3, 1989 [JP] Japan ..... 1-84479

[51] Int. Cl.[5] ..... B41J 2/00

[52] U.S. Cl. ..... 400/120; 400/248; 400/59; 400/207

[58] Field of Search ..... 400/59, 207 E, 229, 400/248, 683, 120

[56] References Cited

U.S. PATENT DOCUMENTS

| | | | |
|---|---|---|---|
| 3,724,923 | 4/1973 | Fischer | 250/202 |
| 4,396,308 | 8/1983 | Applegate et al. | 400/248 |
| 4,784,502 | 11/1988 | Kobayashi | 400/248 |
| 4,929,102 | 5/1990 | Mizutani et al. | 400/248 |
| 4,949,097 | 8/1990 | Imaseki | 400/120 |

FOREIGN PATENT DOCUMENTS

| | | | |
|---|---|---|---|
| 59-93376 | 11/1982 | Japan | 400/207 E |
| 90975 | 5/1983 | Japan | 400/59 |
| 179682 | 10/1983 | Japan | 400/207 E |
| 222380 | 12/1984 | Japan | 400/207 E |
| 229585 | 10/1986 | Japan | 400/207 E |
| 121081 | 6/1987 | Japan | 400/207 E |
| 202778 | 9/1987 | Japan | 400/248 |

*Primary Examiner*—Edgar S. Burr
*Assistant Examiner*—Ren Yan
*Attorney, Agent, or Firm*—Guy W. Shoup; B. Noel Kivlin

[57] ABSTRACT

A thermal printer which always performs a satisfactory printing operation regardless of whether a ribbon cassette mounted for printing houses an ink ribbon for hot release mode printing or an ink ribbon for cold release mode printing. Hot release mode printing is satisfactory for printing normal printing papers, while cold release mode printing is satisfactory for printing OHP (overhead projection) papers. The printer is capable of sensing the difference between ribbon cassette having an ink ribbon for hot release mode printing and a ribbon cassette having an ink ribbon for cold release mode printing, when mounted on the printer for printing. The printer upon sensing the type of ribbon cassette mounted, then adjusts its components, if necessary, so that they are configured in locations appropriate to perform satisfactory printing according to the type of ink ribbon housed in the ribbon cassette mounted. Alternatives include moving a carriage on which the ribbon cassette is mounted toward and away from a platen against which the paper to be printed is placed, moving the location of the ribbon cassette toward or away from the platen against which the paper to be printed is placed, and moving an arm which may guide the ink ribbon after it passes the thermal head.

4 Claims, 4 Drawing Sheets

THERMAL PRINTER

FIELD OF THE INVENTION

This invention relates to a thermal printer which uses hot release and cold release types of ink ribbons in ribbon cassettes to perform printing

BACKGROUND OF THE INVENTION

This invention relates to a thermal printer for printing letters and/or graphics on paper by selectively energizing a set of heat emitting elements of a thermal head, thereby melting the ink of an ink ribbon on the spots pressed by the energized heat emitting elements. More particularly it relates to a thermal printer that can selectively and reliably perform printing using a hot release or cold release type of ink ribbon depending on the type of ink ribbon cassette used.

To begin with, the overall configuration of a conventional thermal printer of the above mentioned type will be briefly described by referring to FIG. 5. A long cylindrical platen 3 is horizontally and rotatably arranged between the two side walls 2A, 2B of frame 1 of the thermal printer for holding a printing paper (not shown) wound around it. A long carriage shaft 4 is arranged parallel with and in front of said cylindrical platen 3 between said two side walls 2A, 2B. A carriage 5 is supported by said carriage shaft 4 in such a manner that it can be moved back and forth along said platen 3 by a drive means such as motor (not shown). A thermal head 6 is mounted on said carriage adjacent to the platen 3 so that it can be moved into contact with and away from the platen 3 . A plurality of heat emitting elements (not shown) are arranged on the side of the thermal head 6 that faces the platen 3. A ribbon cassette 7 housing an ink ribbon is removably mounted on said carriage 5 in such a manner that an exposed portion of the ink ribbon and the printing paper wound around the platen (not shown) are tightly held between the platen 3 and the thermal head 6 when the thermal head 6 is pressed against the platen 3.

To print letters and/or graphics using a thermal printer having a configuration as described above, the thermal head 6 is pressed against the platen 3 with the exposed portion of the ink ribbon and a paper on the platen pressed tightly therebetween. Then a set of heat emitting elements of the thermal head 6 are selectively energized according to data provided for the printing operation. This melts the ink in the ink ribbon at spots corresponding to the energized heat emitting elements and transfers molten ink onto the paper as the carriage 5 is being moved across the paper by a drive means (not shown). While there are a variety of printing papers available for thermal printing, OHP (overhead projection) papers, or light transmitting plastic sheets to be used for the purpose of overhead projection (OHP), require a type of ink ribbon which is different from the type of ink ribbon good for popularly available normal printing papers.

FIG. 6(A) shows the construction of an ink ribbon designed for use with normal printing papers. It is a multilayered structure comprised of a substrate 10 of a film of resin material such as polyethyleneterephthalate, an ink layer 12 of a mixture of carbon and resin carried by said substrate 10, and a overcoat layer 13 of a highly viscous material such as polyamide formed on said ink layer 12. FIG. 6(B) shows the construction of another ink ribbon which is also good for normal printing papers. This ribbon has a release layer 11 formed between the substrate 10 and the ink layer 12. The release layer 11 is made of a wax having a low melting point. For printing letters and/or graphics on a normal printing paper using an ink ribbon of the type of either FIG. 6(A) or FIG. 6(B), a set of heat emitting elements selected for a given letter or graphic are energized and pressed against the ribbon and the paper to melt and transfer ink from corresponding spots of the ink layer 12 onto the paper as thermal head 6 moves across the paper. The ink ribbon is released from the paper while the ink layer 12 is still hot. The force bonding the ink layer 12 to the substrate 10 is relatively small in these types of structures. This operation is called hot release mode printing.

FIG. 6(C) shows the construction of an ink ribbon for use with OHP papers. It is comprised of a substrate 10 of a resin film and an ink layer 12A of a mixture of carbon and wax formed on the substrate 10.

For printing on an OHP printing paper using an ink ribbon of the type illustrated in FIG. 6(C), a set of heat emitting elements are energized and pressed against the ribbon and paper to melt and transfer the ink from corresponding spots of the ink layer 12A onto the paper. The ink ribbon is released from the paper after the ink layer 12A has been cooled and solidified. The force bonding the ink layer 12A to the substrate 10 is relatively large so that the OHP paper has a smooth surface after printing. This operation is called cold release mode printing. Since the mode for releasing an ink ribbon from normal printing paper is different than the mode used for OHP printing paper, a conventional thermal printer designed to be used with both normal printing paper and OHP printing paper is normally is equipped with a specifically devised arrangement as illustrated in FIG. 7. Printing only occurs as the carriage 5 and thermal print head 6 move from left to right, as shown in FIG. 7. The arrangement includes a release arm 20 rotatably supported by the carriage 5. The release arm 20 is held in a fixed position on the left side of (behind) the thermal head 6 and moves with the carriage 5, as the carriage 5 and the print head 6 are being moved from left to right for printing. In this arrangement the release arm 20 can be selectively switched by a drive means (not shown) to one of two positions, either to the position indicated by solid lines or to the position indicated by dashed lines. A release pin 21 is provided projecting from a front end of the release arm 20 in such a manner that the ink ribbon 14 passes around the release pin 21 at a position to the left of the thermal head 6, as printing is occurring from left to right.

When said release arm 20 takes the solid line position (FIG. 7), the release pin 21 is located close to the platen 3, so that during printing the ink ribbon 14 moves toward and around the pin 21 which retards the release of the ink ribbon 14 from the printing paper until the spots of the ink layer 12A of the ink ribbon 14 made molten by the energized heat emitting elements can cool and solidify, thereby performing a cold release mode printing operation. On the other hand, when said release arm 20 takes the dashed line position (FIG. 7), the release pin 21 is located within the outline of the ribbon cassette 7 so that the release pin 21 is not touching the ink ribbon 14. In this position the ink ribbon 14 is immediately released from the printing paper as soon as it passes the thermal head 6. As soon as the ink ribbon moves past the thermal head and while the molten area of the ink layer 12A of the ink ribbon 14 still remains in the molten state the ribbon lifts from the printing paper, thereby performing a hot release mode printing operation.

With a conventional thermal printer as described above, referring to FIG. 7, an operator has to look to see if the ribbon cassette 7 mounted on the carriage 5 contains an ink ribbon for normal printing paper or if it contains one for OHP printing paper and, if necessary, has to operate a switch (not shown) to bring the release arm 20 to the cold release mode position or the hot release mode position, whichever is appropriate. However, selection of a release mode for the ink ribbon 14 based on the observation and judgment of the operator or operation of a switch for switching the release arm to the cold release mode or hot release mode positions when conducted by the operator has a high potential for errors. Errors in observation and misjudgment of the type of ink ribbon 14 in position and errors in switching the release arm to the appropriate position for the applicable release mode can result in poor quality printing or unsuccessful printing. If an ink ribbon 14 intended for use with ordinary printing paper is used with OHP printing paper in the hot release mode, the ink after being transferred onto the printing paper presents a surface which bears undulations that give rise to irregular reflection of light, which can hinder the uniform coloring of the OHP printing paper. If ink ribbon 14 intended for use with ordinary printing paper is used with OHP printing paper in the cold release mode, the ink is not transferred onto the printing paper, thereby making the printing operation unsuccessful because the affinity between the substrate 10 and the ink layer 12 is very large in a hot release mode ink ribbon.

If, on the other hand, a cold release mode ink ribbon intended for use with OHP printing paper is used with ordinary printing paper, the molten ink permeates into the paper producing voids in the printed letters and graphics, making the printing operation unsuccessful.

SUMMARY OF THE INVENTION

It is an object of the present invention to solve the above described problems by providing a thermal printer which detects and adjusts the position of a ribbon cassette according to the release mode of the ink ribbon which it contains when the ribbon cassette is mounted for use in the printer.

In one embodiment, the above object and other objects of the invention are achieved by providing a thermal printer comprising a ribbon cassette housing an ink ribbon and a thermal head mounted on a reciprocally movable carriage. The ribbon cassette is either a ribbon cassette for hot release mode printing or alternatively a ribbon cassette for cold release mode printing selectively mounted and arranged on the carriage moveable toward or away from a surface on which to print, preferably a platen. The thermal printer further comprises a drive means for swingably moving the ribbon cassette mounted on the carriage toward or away from the platen, a sensing means for determining if the ribbon cassette mounted on the carriage is one for hot release mode printing or for cold release mode printing, and a control means for receiving a signal from the sensing means and transmitting a signal, if necessary, to the drive means.

In another embodiment, the above and other objects of the invention are achieved by providing a thermal printer comprising a ribbon cassette housing an ink ribbon, a thermal head mounted on a reciprocally movable carriage with the ribbon cassette, and a release lever arranged downstream of the thermal head (to the left of the thermal head when printing occurs from left to right) with a release pin projecting therefrom. The release pin is positioned such that the ink ribbon is pressed against it during the cold release mode of printing. The release lever is capable of being rotated by a drive means. The ribbon cassette is either a ribbon cassette for hot release mode printing or alternatively a ribbon cassette for cold release mode printing selectively mounted and arranged on the carriage to be swingably moveable toward or away from a platen. The thermal printer further comprises a drive means for swingably moving said ribbon cassette mounted on the carriage toward or away from the platen, a sensing means for determining if the ribbon cassette mounted on the carriage is one for hot release mode printing or for cold release mode printing, and a control means for receiving a signal from the sensing means and transmitting a signal, if necessary, to the drive means. According to an embodiment of the invention, when either a ribbon cassette for hot release mode printing or one for cold release mode printing is mounted on the carriage, the sensing means determines if the ribbon cassette is one for hot release mode printing or cold release mode printing and produces a signal which is transmitted to the control means notifying it of the type of ribbon cassette, and the control means, if necessary, in turn transmits a signal to the drive means to move the ribbon cassette to the appropriate position. The thermal printer can then perform a satisfactory printing operation as a result of having positioned the ribbon cassette in a position which is good for the type of ink ribbon in the cassette regardless of the type of the paper around the platen. According to another embodiment of the invention, when either a ribbon cassette for hot release mode printing or one for cold release mode printing is mounted on the carriage, the sensing means determines if the ribbon cassette is one for hot release mode printing or cold release mode printing and produces a signal which is transmitted to the control means notifying it of the type of ribbon cassette mounted, and the control means, if necessary, in turn transmits a signal to the drive means to move the release lever to the appropriate position. The thermal printer can then perform a satisfactory printing operation as a result of having positioned the release lever in a position which is good for the type of ink ribbon regardless of the type of the paper around the platen.

DETAILED DESCRIPTION OF THE INVENTION

Figure 1:
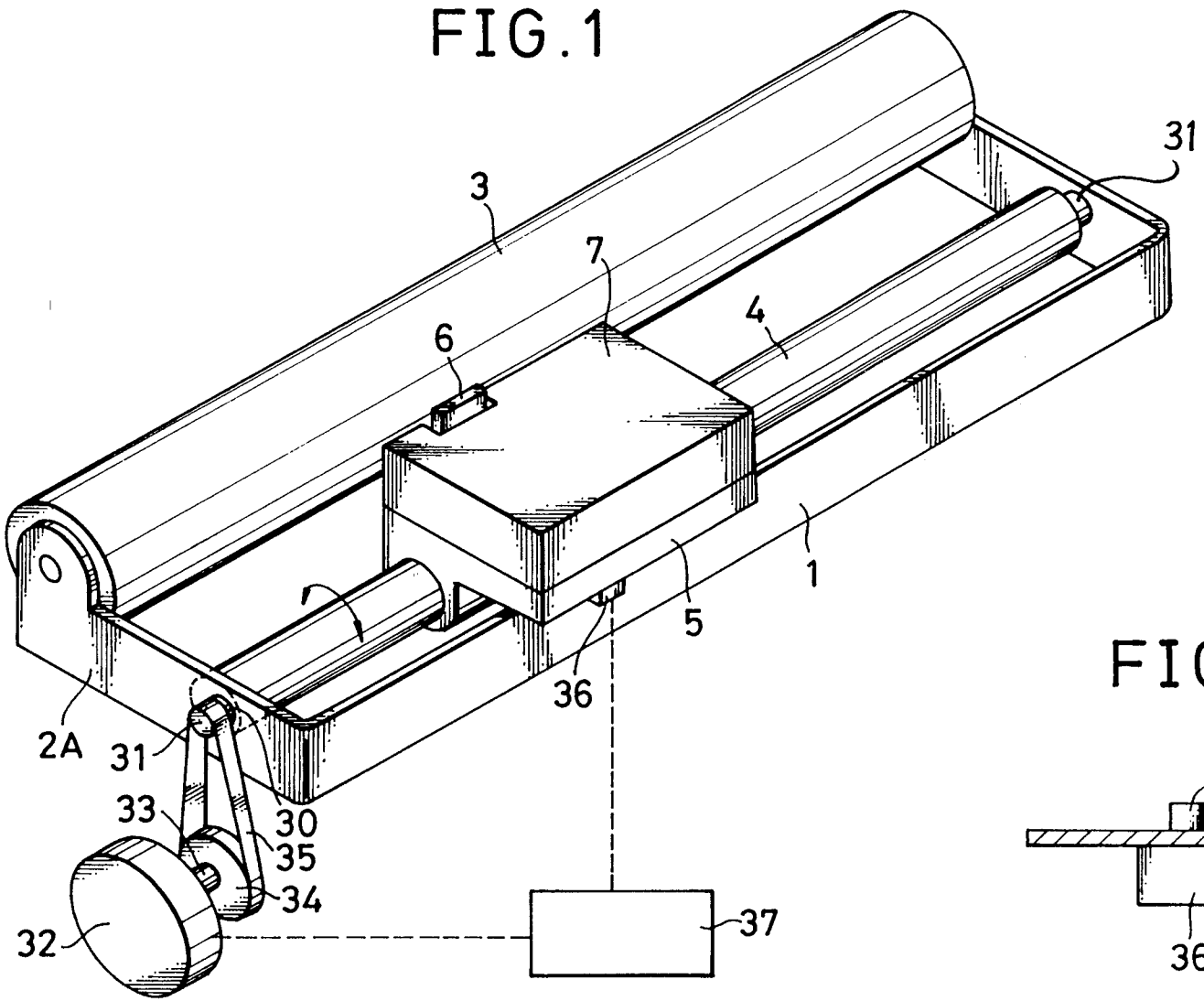
FIG. 1 is a perspective view of an embodiment of the invention.

Now the invention will be described by referring to FIGS. 1 through 4 that illustrate an embodiment of the invention. In the drawings the components are indicated by identical reference symbols, similar to those of the conventional thermal printer described above, and therefore the previously described components will not be described any further.

FIG. 1 shows an embodiment of the thermal printer of the present invention, wherein a small diameter eccentric shaft 30, preferably made of steel, is projecting from both ends of a carriage shaft 4, preferably made of steel, that supports a carriage 5, preferably made of plastic. The central axes of the small diameter eccentric shafts 30 are colinear. This colinear axis is displaced from the central axis of the carriage shaft 4. The carriage shaft 4 is supported in the frame 1 on the eccentric shafts 30 and when the carriage shaft is rotated, it rotates about the colinear central axis of the eccentric shafts 30, thereby moving the central axis of the carriage shaft 4 toward and away from a surface on which to print, preferably a platen 3, while maintaining a parallel alignment with the platen 3. A small diameter pulley 31, preferably made of plastic, is engagedly fitted to the eccentric shaft 30. A drive means, preferably a stepping motor 32 having a shaft 33, is arranged near the pulley 31 and a large diameter pulley 34, preferably made of plastic is engagedly fitted to the output shaft 33 of the stepping motor. The pulleys 31 and 34 are connected by an endless belt 35, preferably made of plastic, for transmitting the motion of the stepping motor 32 to the eccentric shaft 30. As the eccentric shaft 30 is rotated back and forth, by a given angle, the rotation of the eccentric shaft 30 is transmitted to the carriage shaft 4 in such a manner that the carriage shaft 4 is rotated back and forth, as indicated by the arrows in FIG. 1. This motion of the carriage shaft 4 moves the carriage 5 as well as the ribbon cassette assembly 7, mounted on the carriage 5, into contact with and away from the platen 3, while being held in alignment with the platen 3 by alignment means (not shown).

Figure 2:
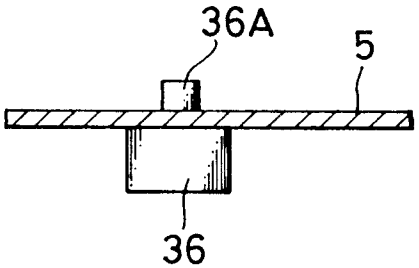
FIG. 2 is a schematic illustration of a sensor switch used with the embodiment of FIG. 1.
Figure 3A:
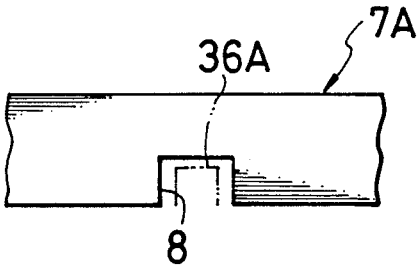
FIGS. 3(A) and 3(B) are schematic illustrations of the identical areas of ribbon cassettes having different configurations.
Figure 3B:
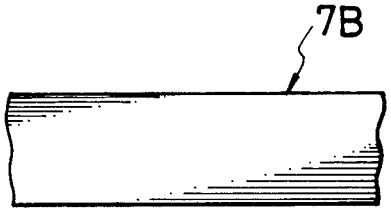

The carriage 5 is provided with a sensing means 32, e.g. a sensor switch 36 as illustrated in FIG. 2. The sensor switch 36 has an actuator 36A as sensing member. The switch is located on the carriage 5, carrying a ribbon cassette assembly 7, at a location such that the sensor switch 36 is off when the actuator 36A is not pressed. The ribbon cassette assembly 7 can be configured as described FIGS. 3(A) and 3(B). A ribbon cassette 7A that houses an ink ribbon for printing on ordinary printing paper in a hot release mode has an opening 8 designed to avoid the actuator 36A from abutting it when it is mounted on the carriage 5 as illustrated in FIG. 3(A). Whereas a ribbon cassette 7B that houses an ink ribbon for printing on OHP paper in a cold release mode is designed so that it abuts the actuator 36A to close a sensor switch circuit when it is mounted on the carriage 5, as illustrated in FIG. 3(B).

The sensor switch 36 is connected to a control means 37 such as a CPU that controls the stepping motor 32 according to a motor control signal depending on the signal sensed from the sensor switch 36.

Figure 4A:
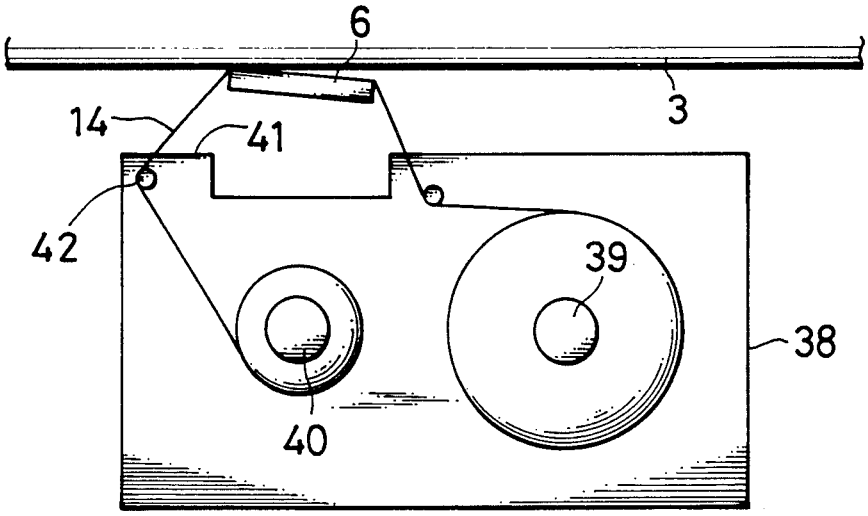
FIGS. 4(A) and 4(B) are schematic plan views of the embodiment of FIG. 1 showing its operating positions.
Figure 4B:
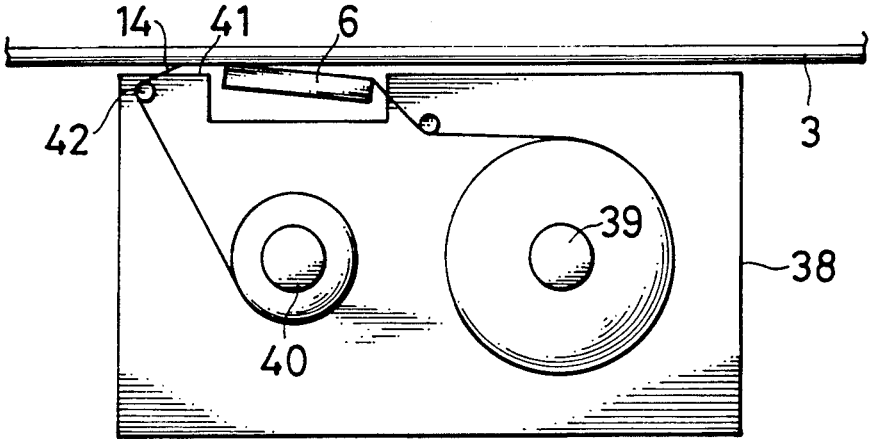
Figure 5:
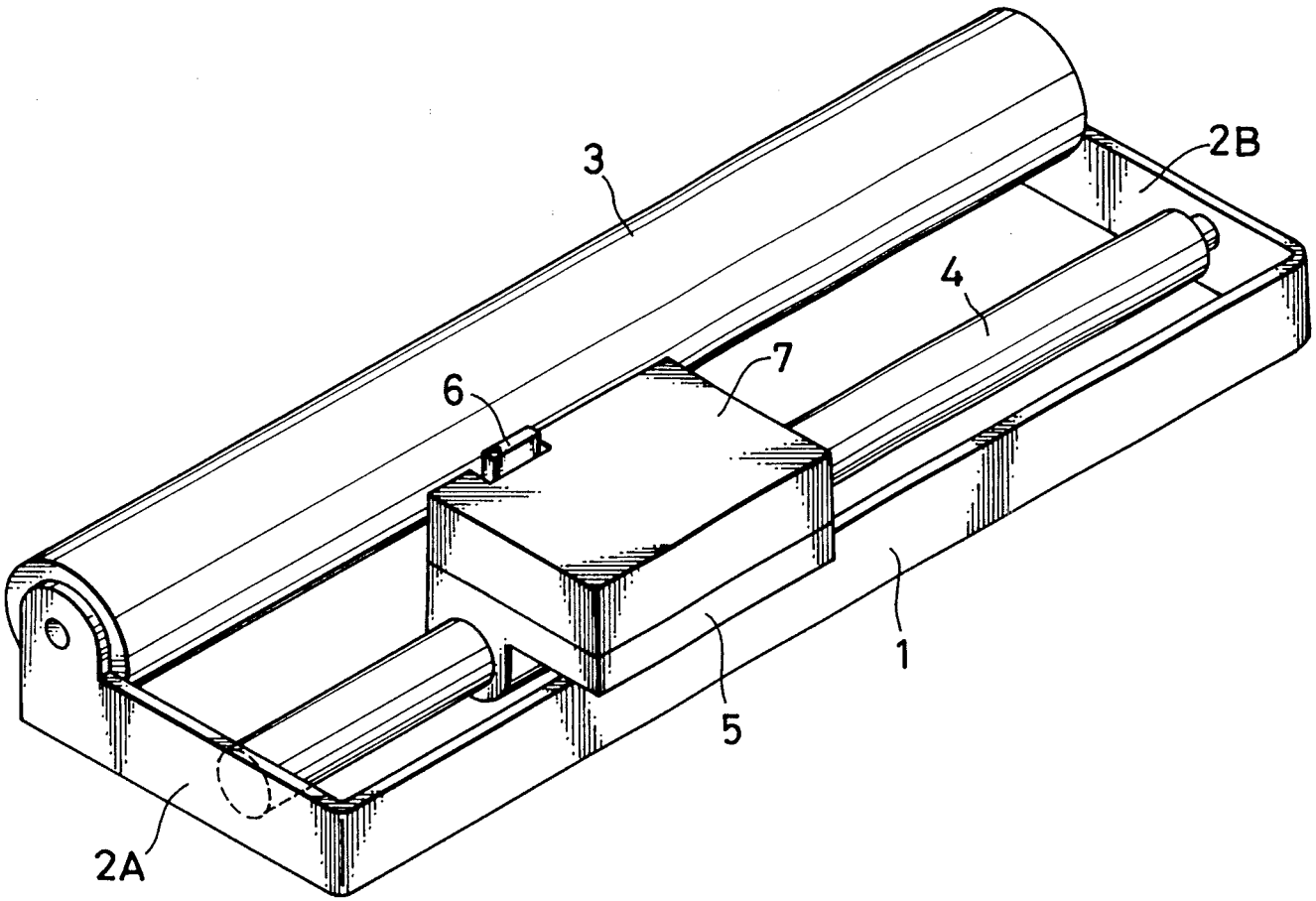
FIG. 5 is a perspective view of a typical conventional thermal printer.
Figure 6A:
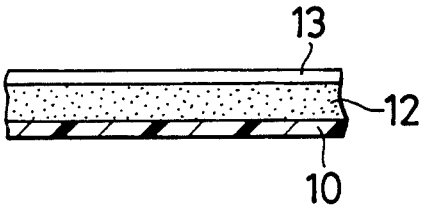
FIGS. 6(A), 6(B) and 6(C) are cross sectional views showing ink ribbons having different configurations.
Figure 6B:
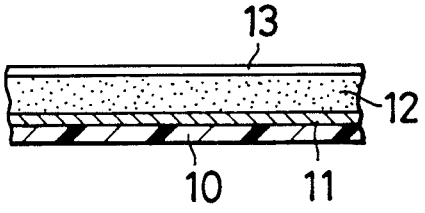
Figure 6C:
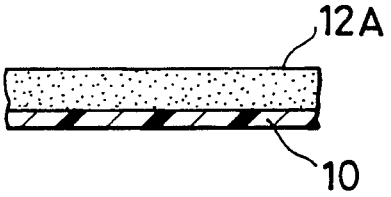

As shown in FIGS. 4(A) and 4(B), the ends of an ink ribbon 14 contained in the ribbon cassette assembly 7 are respectively securely fitted to a feed bobbin 39 and a take-up bobbin 40 disposed within a main body 38 of the ribbon cassette 7. The cassette assembly 7 is moved with the carriage 5 closer to or away from the platen 3 by the rotation of the carriage shaft 4 which is rotated by the stepping motor 32. A rectangular flat projection 41 is integrally formed as part of the main body 38 of the ribbon cassette assembly on the side of the assembly adjacent to the platen (front side) and at the take-up bobbin 40 end of the main body 38, in such a manner that, when the ribbon cassette assembly 7 is moved, with the carriage, close to the platen 3, the flat projection 41 is also located very close to the platen 3 with a narrow clearance therebetween. The flat projection 41 has a guide pin 42 formed near its front side at the take-up bobbin 40 end of the main body 38. As printing is performed from left to right in Figures 4(A) and 4(B), the guide pin 42 guides a portion of the ink ribbon 14 immediately to the left of the thermal head 6 (downstream of the thermal head) so that ink ribbon 14 is released from the platen 3 after an appropriate period of time, in accordance with the position of the guide pin 42 which is dependent on the location of the ribbon cassette assembly 7 in relation to the platen 3, on which printing is taking place.

The embodiment having a configuration as described above operates in the following manner. When the ribbon cassette assembly 7 is not mounted on the carriage 5, the carriage 5 is in a position which is good for hot release as illustrated in FIG. 4(A). In this condition, when the ribbon cassette 7A containing a hot release mode ink ribbon good for printing on ordinary paper is mounted on the carriage 5, it keeps the sensor switch 36 in an off state because of the opening 8 of the cassette 7A formed in front of the actuator 36A of the sensor switch 36, so that no signal is transmitted from the control means 37 to the stepping motor 32. Therefore, if the thermal head 6 is pressed against the platen 3 for printing, the guide pin 42 of the ribbon cassette 7A that takes a position as shown in FIG. 4(A). This position brings the ink ribbon 14 under tension so that it is released from the paper on the platen 3 (not shown) immediately after the ink ribbon passes the thermal head 6. Consequently, the ink ribbon 14 is taken away from the paper while those areas of the ink ribbon 14 that have been made molten by the selectively heated heat emitting elements of the thermal head 6 remain in the molten condition. In other words, a hot release mode printing operation which is good for printing on ordinary paper is successfully carried out.

On the other hand, when the ribbon cassette 7B containing a cold release mode ink ribbon 14 good for printing on OHP paper is mounted on the carriage 5, it pushes the actuator 36A to close the circuit of the sensor switch 36 because of the nonexistence of an opening 8 of the cassette 7B in front of the actuator. Therefore, the sensor switch 36 transmits a signal to the control means 37 notifying it that a ribbon cassette of the type 7B has been sensed and the control means 37 in turn starts transmitting a signal to the stepping motor 32 which starts its motion. Consequently, the eccentric shaft 30 is rotated a given angle by the stepping motor 32 which thereby rotates the carriage shaft 4 to swingably move it closer to the platen 3. Accordingly, the ribbon cassette 7B is moved toward the platen 3, with the carriage 5, until it reaches the position as shown in FIG. 4(B) at which point the control means 37 stops transmitting the signal to the stepping motor 37 stopping its motion.

Then, when the thermal head 6 is pressed against the platen 3 for printing while the ribbon cassette 7B is in the position as illustrated in FIG. 4(B), the guide pin 42 provided in the ribbon cassette 7B brings the ink ribbon 14 under tension in a direction along the face of platen 3 so that the ink ribbon 14 is released from the platen 3 after it moves along the platen 3 a certain distance immediately after the thermal head 6. Thus, the ink ribbon 14 is taken away from the paper only after those areas of the ink ribbon 14 that have been made molten by the selectively heated heat emitting elements of the thermal head 6 have cooled and solidified. In other words, a cold release mode printing operation which is good for printing on OHP paper is successfully carried out.

Now, if the ribbon cassette 7B for OHP paper is removed from the carriage 5, the circuit of the sensor switch 36 that has been closed by the pressing action of the ribbon cassette 7B against the actuator 36A is opened which transmits a signal to the control means 37, which in turn transmits a signal to the stepping motor to moving the carriage 5 away from the platen 3 to the position as shown in FIG. 4(A). It should be noted that, if the ribbon cassette 7B is removed from the carriage 5 when a main power switch of the thermal printer is turned OFF, the same operation is conducted when the power switch is turned ON the next time.

With this embodiment, when a ribbon cassette 7A for hot release mode printing or a ribbon cassette 7B for cold release mode printing is mounted on the carriage 5, the control means 37 appropriately operates the stepping motor 32 in response to the signal transmitted from the sensor switch 36 to swingably move the ribbon cassette assembly 7 toward or away from the platen 3 in accordance with the release mode of the ink ribbon 14 housed in the ribbon cassette assembly 7, so that a printing operation is conducted either in hot release mode or in cold release mode as appropriate to always ensure high-quality printing and avoid any unsatisfactory printing due to mismatching of the ink ribbon and the release mode position of the carriage of the printer. Since this embodiment does not use a release arm for releasing the ink ribbon from the printing paper, it is free of any ink ribbon troubles that may be caused by a release pin which is out of position relative to the release arm and therefore fails to guide the ink ribbon under a desired condition.

Several alternatives are available for the above-described embodiment.

(1) While in the above described embodiment the ribbon cassette assembly 7 is moved toward or away from the platen 3 with the carriage for changing the release mode, in another embodiment the ribbon cassette assembly 7 alone may alternatively be moved to change the mode.

Figure 7:
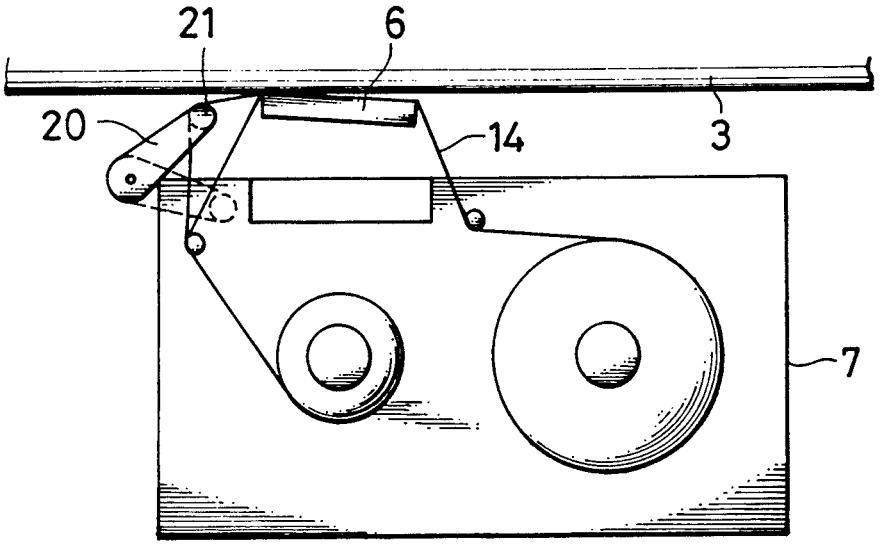
FIG. 7 PRIOR ART
FIG. 7 is a schematic plan view of a conventional thermal printer.

(2) A release arm 20 as illustrated in FIG. 7 may be used to change the release mode so that an arm 20 is rotated by a drive means (not shown) in response to a signal transmitted from the sensor switch 36.

(3) The sensing means may be realized in the form of a photosensor for sensing the existence of a ribbon cassette 7A or 7B, which are realized in a form that can be easily and reliably detected by the photosensor, such as a notch and lack thereof in the casing described above, or any other conceivable form where the difference between the presence and absence of a barrier to light can be detected by a photosensor.

(4) Each of the ribbon cassettes 7A and 7B may carry a graphic pattern which is different from its counterpart so that the photosensor can identify the particular ribbon cassette mounted by the graphic pattern it carries.

Many other changes and modifications may be possible to the present invention without departing the spirit and scope of the invention.

As is apparent from the above description, a thermal printer according to the present invention ensures satisfactory printing regardless of the type of the paper loaded on the printer. The printer detects and positions its components in an ink ribbon release mode that matches the type of the ink ribbon housed in the ribbon cassette loaded on the printer.

What is claimed is:

1. A thermal printer for printing on a printing surface, said thermal printer comprising:

a ribbon cassette housing an ink ribbon;

a movable carriage, wherein said ribbon cassette is either a ribbon cassette for hot release mode printing or alternatively a ribbon cassette for cold release mode printing, said ribbon cassette being selectively mounted and arranged on said carriage to be movable toward and away from said printing surface;

a drive means for moving said ribbon cassette mounted on said carriage toward and away from said printing surface;

a sensing means for detecting whether said ribbon cassette mounted on said carriage is one for hot release mode printing or for cold release mode printing; and a control means for detecting the type of cassette detected by said sensing means and for selectively transmitting a signal to said drive means so that said drive means moves said carriage to a first or a second position where said positions are reached once the carriage stops after moving toward and away from said printing surface respectively, according to the type of ribbon cassette mounted.

2. A thermal printer according to claim 1, wherein said drive means for moving said ribbon cassette toward or away from said printing surface comprises and eccentric shaft and a drive motor for driving said eccentric shaft.

3. A thermal printer according to claim 1, wherein said sensing means arranged on the carriage is a sensor switch having a sensing member.

4. A thermal printer according to claim 1, wherein said sensing means arranged on the carriage is a photosensor.

* * * * *